US005851748A

United States Patent [19]

Tang et al.

[11] Patent Number: 5,851,748

[45] Date of Patent: Dec. 22, 1998

[54] PHOTOGRAPHIC MATERIALS AND PROCESS COMPRISING A PARTICULAR ACYLACETANILIDE YELLOW DYE-FORMING COUPLER

[75] Inventors: Ping-Wah Tang; Stanley W. Cowan; David J. Decker, all of Rochester; Thomas A. Rosiek, Honeoye Falls, all of N.Y.

[73] Assignee: Eastman Kodak Company, Rochester, N.Y.

[21] Appl. No.: 766,194

[22] Filed: Dec. 12, 1996

[51] Int. Cl.[6] ..... G03C 1/08; G03C 7/26; G03C 7/32

[52] U.S. Cl. ..... 430/557; 430/556; 430/389; 430/523; 430/543

[58] Field of Search ..... 430/543, 556, 430/389, 523, 557

[56] References Cited

U.S. PATENT DOCUMENTS

| | | | |
|---|---|---|---|
| 4,022,620 | 5/1977 | Okumura et al. | 96/56.2 |
| 4,404,274 | 9/1983 | Arai et al. | 430/389 |
| 5,066,574 | 11/1991 | Kubota et al. | 430/557 |
| 5,215,877 | 6/1993 | Tomotake et al. | 430/557 |
| 5,215,878 | 6/1993 | Tsoi | 430/557 |
| 5,217,857 | 6/1993 | Hayashi et al. | 430/556 |
| 5,719,018 | 2/1998 | Katsumata et al. | 430/557 |

*Primary Examiner*—Geraldine Letscher
*Attorney, Agent, or Firm*—Arthur E. Kluegel

[57] ABSTRACT

The invention provides a photographic element comprising a silver halide emulsion layer having associated therewith a yellow dye-forming coupler having the formula:

wherein X, Y, Z, W are independently selected from the group consisting of H, alkyl, aryl, halogen, alkoxy and aryloxy groups, provided that X and W may join to form a saturated ring;

Each A is selected from the group consisting of halogen, alkoxy and aryloxy groups;

m is an integer from 1 to 3;

each B is independently selected from the group consisting of —C(O)$OR_2$ and —$NHSO_2R_3$ wherein $R_2$ and $R_3$ are independently selected from the group consisting of alkyl and aryl groups;

n is an integer from 1 to 3; and $R_1$ is a substituent group.

18 Claims, No Drawings

PHOTOGRAPHIC MATERIALS AND PROCESS COMPRISING A PARTICULAR ACYLACETANILIDE YELLOW DYE-FORMING COUPLER

FIELD OF THE INVENTION

The invention relates to a silver halide emulsion layer containing element in which an acylacetanilide yellow dye forming coupler having a particular formula provides an advantageous set of properties including dye forming activity, hue, coupler and dye stability.

BACKGROUND OF THE INVENTION

There is a need for yellow couplers which provide an improved combination of properties, particularly those properties important to color negative print applications. Among the currently used couplers, image dye and coupler stabilities are not at the level that would be desirable. Moreover, there is a strong desire to replace the present couplers with ones having higher reactivity for dye formation. Other disadvantages of available couplers include marked color fog and color stain during storage.

One attempt to improve the quality of yellow couplers is described in U.S. Pat. No. 4,022,620. It is proposed in this patent to use an acylacetanilide coupler having a hydantoin coupling-off-group. While such couplers have provided some advantages they have still not shown a satisfactory improvement in the desired properties. They are still limited not only by unsatisfactory coupling activity and image dye stability, but also by high cost of making the coupling-off group.

U.S. Pat. No. 4,404,274 suggests various acylacetanilide yellow couplers containing (α-diacylamino cyclic coupling-off groups. The ring may be completed by any nonmetallic atoms necessary to form a 4-, 5-, or 6-membered ring. Examples include a broad array of atoms including fused aliphatic and aromatic rings. Succinimide coupling-off groups are among those suggested and there are separately suggested various oxycarbonyl or sulfonamido substituents on the acetanilide ring. However, none of the formulas suggested provides the desired combination of properties.

Therefore, it remains a problem to be solved to provide a photographic element comprising a yellow dye-forming coupler which provides an improved combination of properties.

SUMMARY OF THE INVENTION

The invention provides a photographic element comprising a silver halide emulsion layer having associated therewith a yellow dye-forming coupler having the formula:

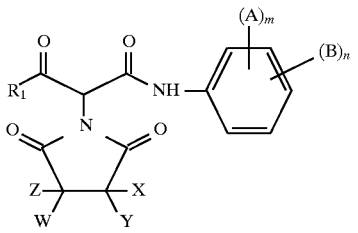

wherein X, Y, Z, W are independently selected from the group consisting of H, alkyl, aryl, halogen, alkoxy and aryloxy groups, provided that X and W may join to form a saturated ring;

each A is selected from the group consisting of halogen, alkoxy and aryloxy groups;

m is an integer from 1 to 3;

each B is independently selected from the group consisting of —C(O)OR$_2$ and —NHSO$_2$R$_3$ wherein R$_2$ and R$_3$ are independently selected from the group consisting of alkyl and aryl groups;

n is an integer from 1 to 3; and

R$_1$ is a substituent group.

The invention also provides a process for forming an image in the foregoing element.

The invention provides a photographic element comprising a yellow dye-forming coupler which provides an improved combination of properties including density, hue and stability of the coupler and dye.

DETAILED DESCRIPTION OF THE INVENTION

As indicated in the Summary of the Invention, the invention provides a photographic element comprising a silver halide emulsion layer having associated therewith a yellow dye-forming coupler having the formula:

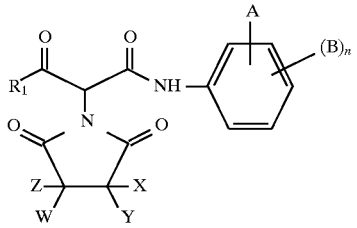

X, Y, Z, W are independently selected from the group consisting of H, alkyl, aryl, halogen, alkoxy and aryloxy groups, provided that X and W may join to form a saturated ring. Hydrogen, phenyl, and alkyl groups of one or two carbon atoms are readily synthesized. Methyl, ethyl, phenyl, fluoro, chloro, bromo, iodo, and hydrogen are the most conveniently used.

Each A is selected from the group consisting of halogen, alkoxy and aryloxy groups, and m is an integer from 1 to 3. The presence of this substituent is important to obtaining the desired hue and activity of the coupler. Alkoxy and halogen are preferred and especially chloro and alkoxy groups are desirable such as those having up to 16 carbon atoms. Conveniently, a group A is located ortho to the anilino nitrogen.

Each B is independently selected from the group consisting of —C(O)OR$_2$ and —NHSO$_2$R$_3$ wherein R$_2$ and R$_3$ are independently selected from the group consisting of alkyl and aryl groups. n is an integer from 1 to 3. The groups R$_2$ and R$_3$ may be selected with sufficient aliphatic carbon atoms to render the coupler nondiffusible during processing. In such cases, there are typically 8 or more aliphatic carbon atoms. The coupler may also be rendered nondiffusible through the location of aliphatic carbon atoms in other positions of the coupler molecule. Desirably, at least one B is an oxycarbonyl group. R$_2$ may typically contain from 6 to 24 carbon atoms.

R$_1$ is a substituent group as defined hereinafter. It is desirable that the substituent be linked to the balance of the coupler through a tertiary carbon atom such as tertiary butyl, tertiary octyl or tertiary pentyl groups. Other examples include 1-substituted cycloalkyl groups (cyclopropyl, cyclobutyl, cyclopentyl, cyclohexyl, etc.) The 1- substituent is suitably a methyl group.
The following are examples of couplers of the invention. "tBu" means t-butyl.
Y-1
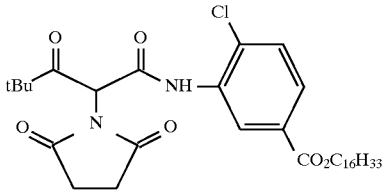
Y-2
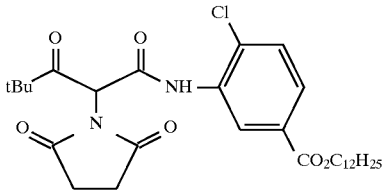
Y-3
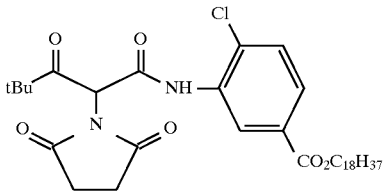
Y-4
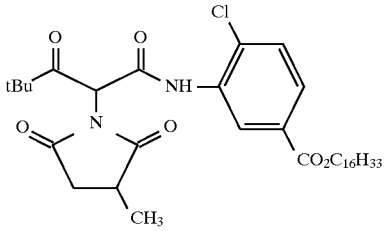
Y-5
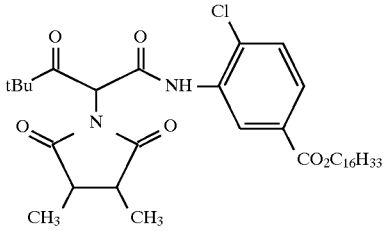
Y-6
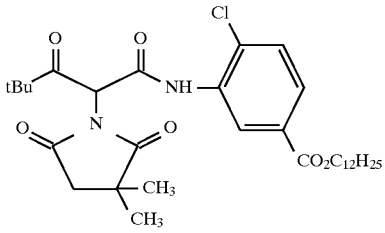
Y-7
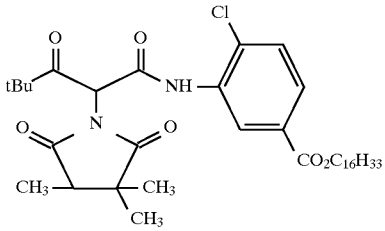
-continued
Y-8
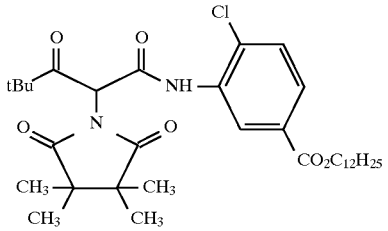
Y-9
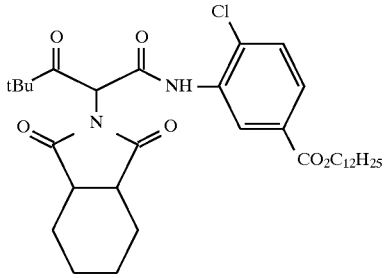
Y-10
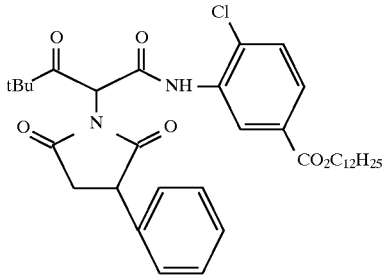
Y-11
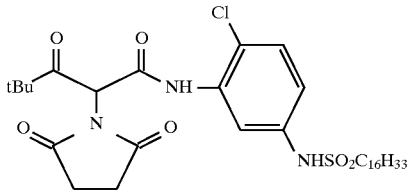
Y-12
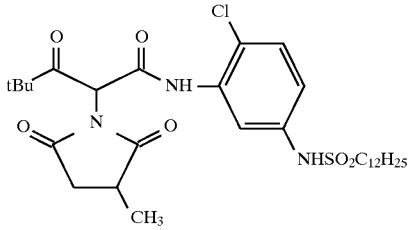
Y-13
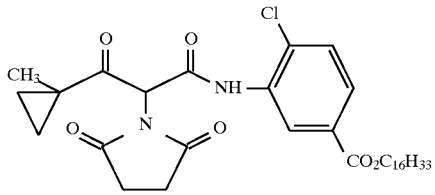
Y-14
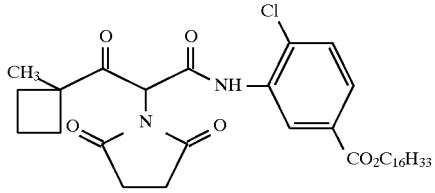

-continued

Y-15

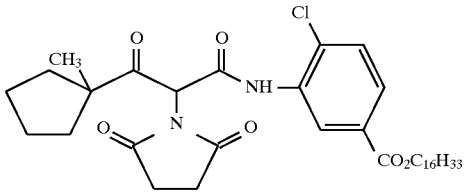

Y-16

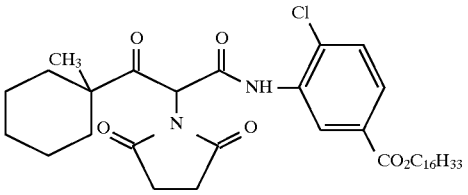

Y-17

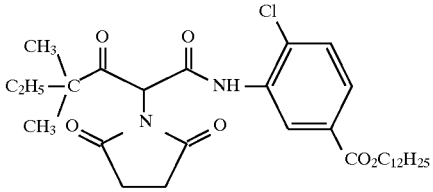

Y-18

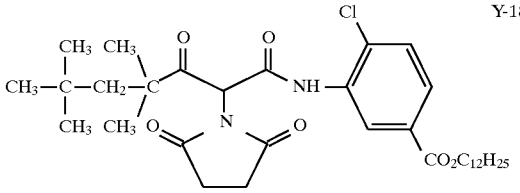

Y-19

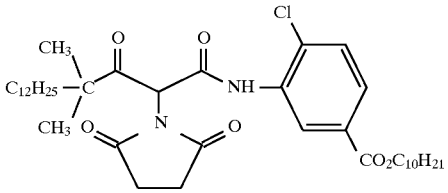

Y-20

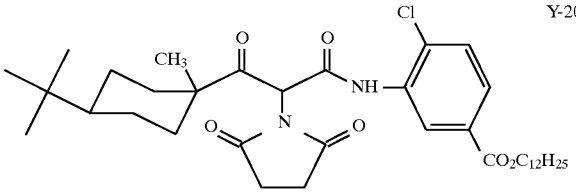

Y-21

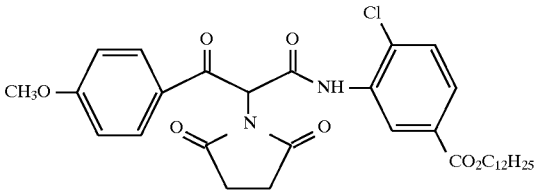

Y-22

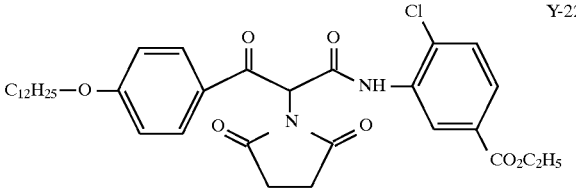

-continued

Y-23

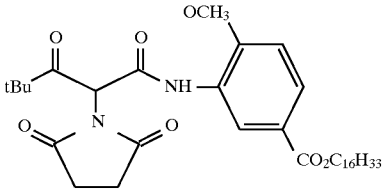

Y-24

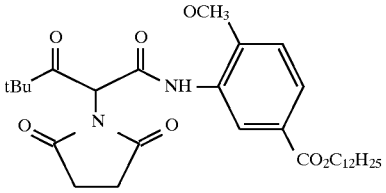

Y-25

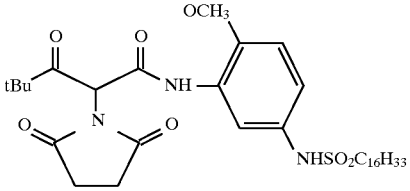

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo- 1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4 nonylphenylsulfonyl, and p-toluylsulfonyl; sulfonyloxy, such as dodecylsulfonyloxy, and hexadecylsulfonyloxy; sulfmyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VII. Color materials are described in Sections X through XIII. Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961).

Preferably such couplers are phenols and naphthols that form cyan dyes on reaction with oxidized color developing agent.

Couplers that form magenta dyes upon reaction with oxidized color developing agent are described in such representative patents and publications as:

U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as:

U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861;

German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

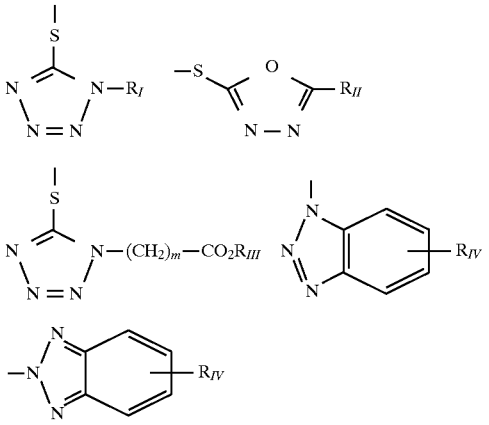

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

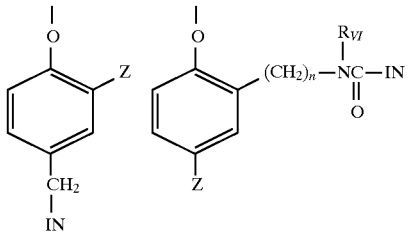

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIALR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1
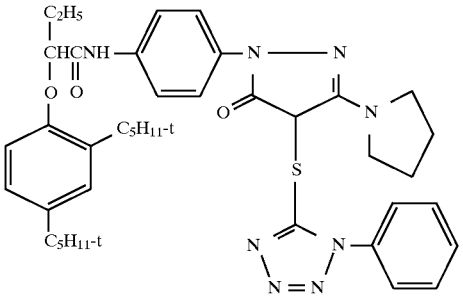
D2
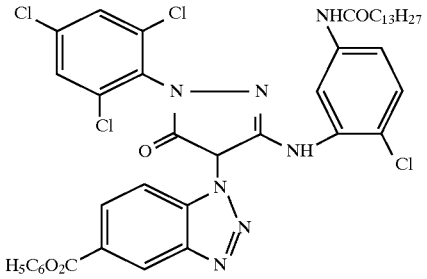
D3
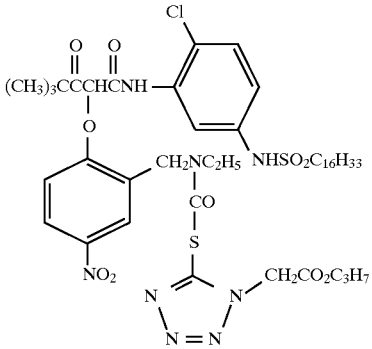
D4
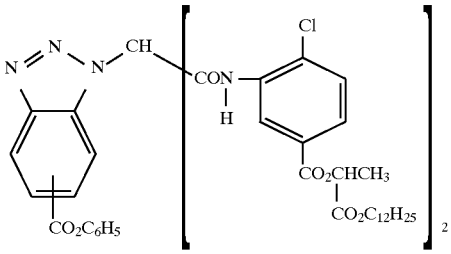
D5
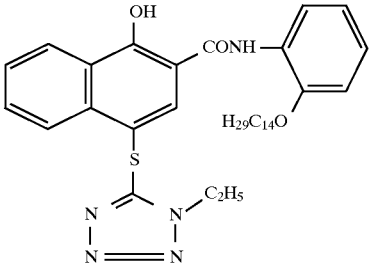
-continued
D6
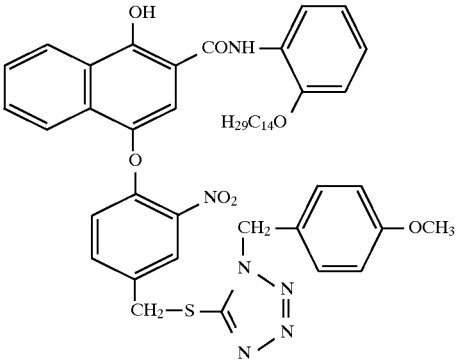
D7
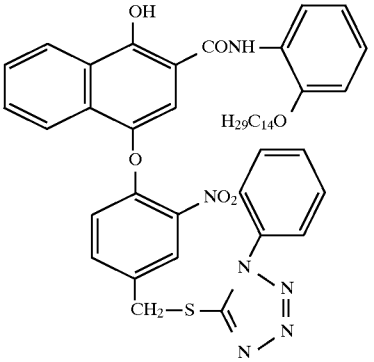
D8
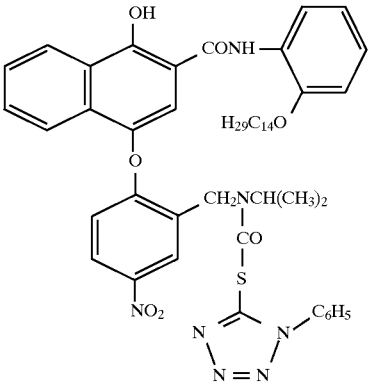
D9
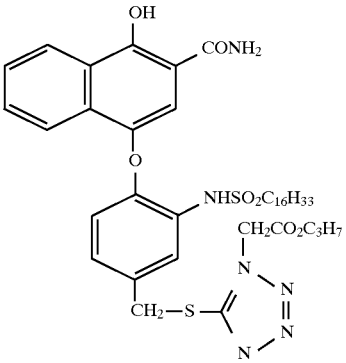

-continued

D-10

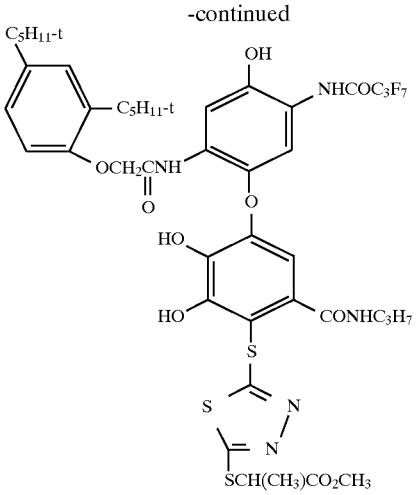

D11

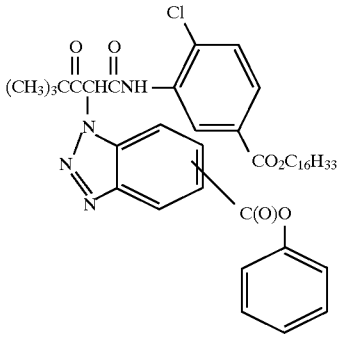

D12

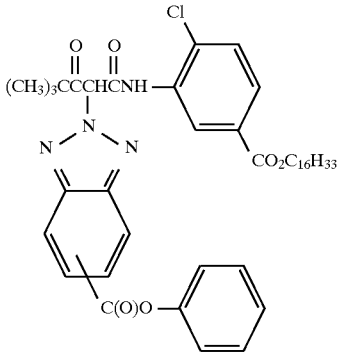

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following:

Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element is designed for image capture, and speed (the sensitivity of the element to low light conditions) is usually critical to obtaining sufficient image in such elements. When such elements are to be subsequently used to optically generate a color print, they are provided on a transparent support. They may then be processed, for example, in known color negative processes such as the Kodak C-41 process as described in The British Journal of Photography Annual of 1988, pages 191–198. If such an element is to be employed to generate a viewable projection print as for a motion picture, a process such as the Kodak ECN-2 process described in the H-24 Manual available from Eastman Kodak Co. may be employed to provide the print on a transparent support. Color negative development times are typically 3'15" or less and desirably 90 or even 60 seconds or less.

Elements destined for color reflection prints are provided on a reflective support and may be exposed via optical negative/positive printing and processed, for example, using the Kodak RA-4 process as described in The British Journal of Photography Annual of 1988, Pp 198–199; color projection prints may be processed, for example, in accordance with the Kodak ECP-2 process as described in the H-24 Manual. Color print development times are typically 90 seconds or less and desirably 45 or even 30 seconds or less.

To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

The element of the invention may be of any type, but color print elements are particularly contemplated. In such elements, the stability of the coupler and dye are especially important to preserving the image quality.

The couplers of the invention may be synthesized in accordance with the following scheme:

SYNTHETIC SCHEME

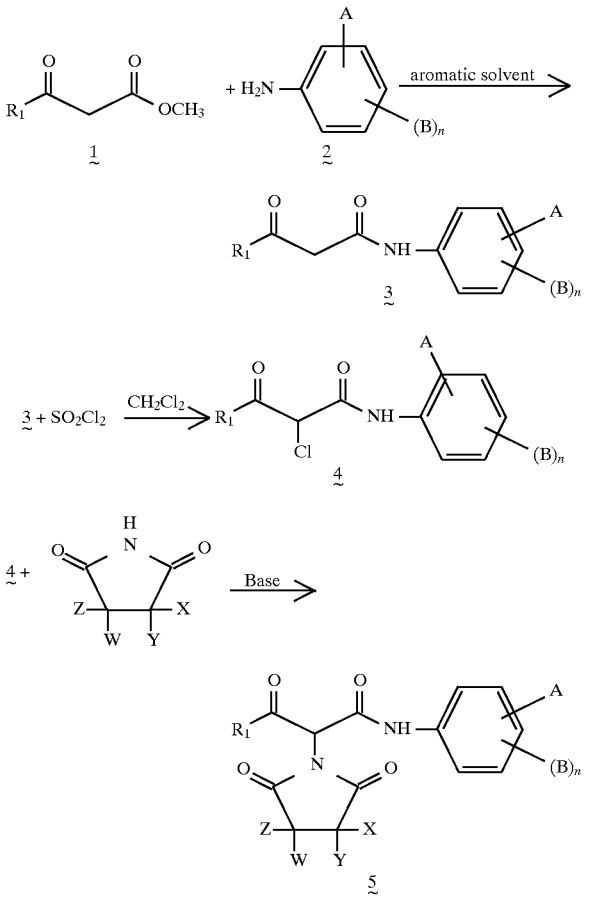

SYNTHETIC EXAMPLE

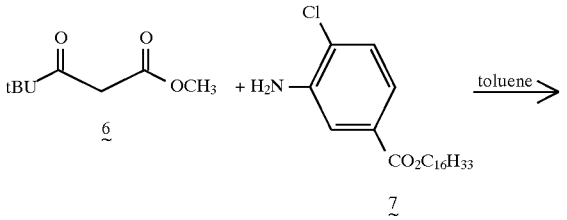

-continued

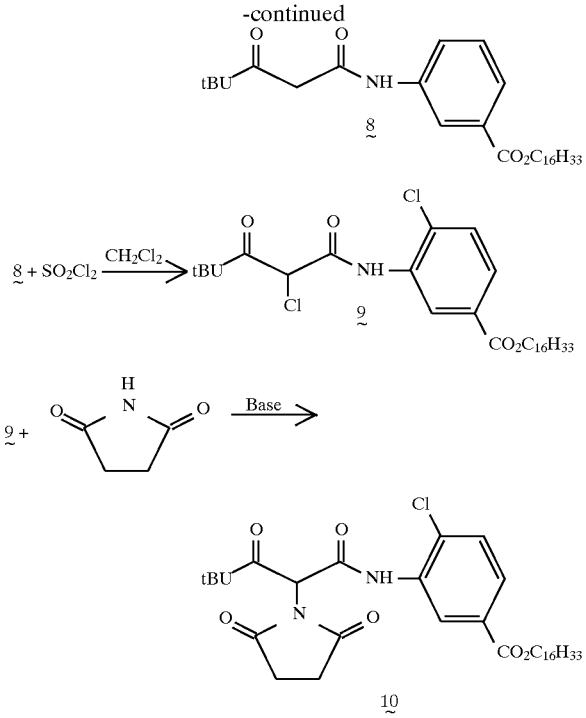

Invention Coupler: Y-1

Preparation of yellow coupler Y-1:

2-Butanimido-N-(2-chloro-5(hexadecyloxycarbonyl) phenyl)-4,4-dimethyl-3-oxopentanamide [Y-1].

To a stirred mixture of 41.75g (0.075 mol) of 2-chloro-N-(2-chloro-5(hexadecyloxycarbonyl)phenyl)-4,4-dimethyl-3-oxopentanamide 9 and 7.44g (0.075 mol) of succinimide in 100 mL of ethyl acetate at room temperature was added dropwise 18.82mL (17.28g, 0.15 mol) of 1,1,3,3-tetramethylguanidine. The clear homogeneous solution turned cloudy and white precipitate formed after having been stirred for 10 minutes. The mixture was stirred at room temperature for 15 hours. Thin layer chromatography (TLC) (ligroin/$CH_3COOC_2H_5$:4/l) indicated the complete reaction, as evidenced by the disappearance of the two starting materials and the newly formed desired yellow coupler (Rf:0.14). The solid precipitate was filtered off by suction and washed thoroughly with ethyl acetate. The filtrate and the washings were combined. It was washed once with water, once with 200 mL of 10% aqueous solution of HCl, and with a saturated solution of NaCl (3×). The neutral ethyl acetate phase was dried over $MgSO_4$ and concentrated in vacuo to yield a solid. The resulting solid was slurried with ligroin for 1 hour. It was collected under suction and dried. TLC showed one spot material. Weight: 37.2g (80%). HPLC indicated 98.7%. All other analytical data confirmed the assigned structure of Y-1 (10).

PHOTOGRAPHIC EXAMPLES

Preparation of Photographic Elements

On a gel-subbed, polyethylene-coated paper support were coated the following layers:

First Layer

An underlayer containing 3.23 grams gelatin per square meter.

Second Layer For The Data In Tables III and IV

A photosensitive layer containing (per square meter) 2.15 grams gelatin, an amount of blue-sensitized silver chloride emulsion containing 0.28 grams silver; a dispersion containing $8.83\times10^{-4}$ mole of coupler; and 0.043 gram surfactant Alkanol XC (trademark of E.I. Dupont Co.)(in addition to the Alkanol XC used to prepare the coupler dispersion). The coupler dispersion contained all of the gelatin in the layer except that supplied by the emulsion, the coupler, an amount of dibutyl phthalate equal to one-third of the weight of coupler, an amount of 2-(2-butoxyethoxy)ethyl acetate equal to the amount of coupler times 0.28, an amount of stabilizer S-1 equal to the amount of coupler times 0.24, and 0.22 gram Alkanol XC.

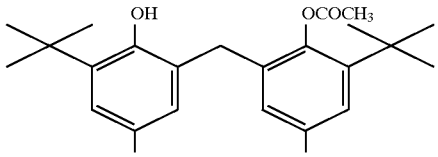

S-1

Second Layer For The Data In Table II

A photosensitive layer containing (per square meter) 2.15 grams gelatin, an amount of blue-sensitized silver chloride emulsion containing 0.28 grams silver; a dispersion containing $8.83\times10^{-4}$ mole of coupler; and 0.043 gram surfactant Alkanol XC (trademark of E.I. Dupont Co.) (in addition to the Alkanol XC used to prepare the coupler dispersion). The coupler dispersion contained all of the gelatin in the layer except that supplied by the emulsion, the coupler, an amount of dibutyl phthalate equal to the amount of coupler times 0.61, an amount of stabilizer S-1 equal to the amount of coupler times 0.24, and 0.22 gram Alkanol XC.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

Preparation of Processed Photographic Examples

Processed samples were prepared by exposing the coatings through a step wedge and processing as follows:

| Process Step | Time (min.) | Temp. (°C.) |
|---|---|---|
| Developer | 0.75 | 35.0 |
| Bleach-Fix | 0.75 | 35.0 |
| Water Wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing Agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach Fix** | |
| Solution of ammonium thiosulfate | 71.85 g |
| Ammonium sulfite | 5.10 g |
| Sodium Metabisulfite | 10.00 g |
| Acetic acid | 10.20 g |

-continued
| | |
|---|---|
| Ammonium ferric ethylenediaminetetra acetate | 48.58 g |
| Ethylenediaminetetraacetic acid | 3.86 g |
| pH adjusted to 6.7 at 26.7° C. | |
Comparative Examples
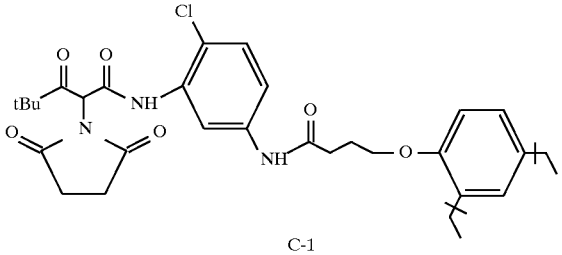
C-1
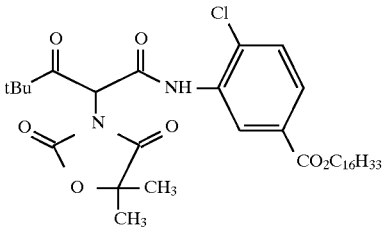
C-2
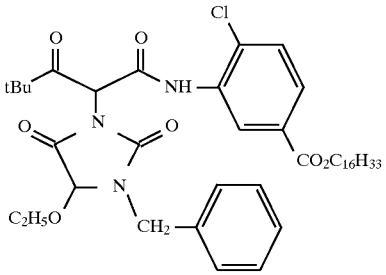
C-3
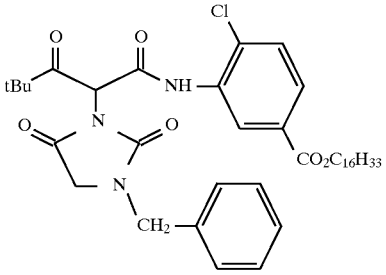
C-4
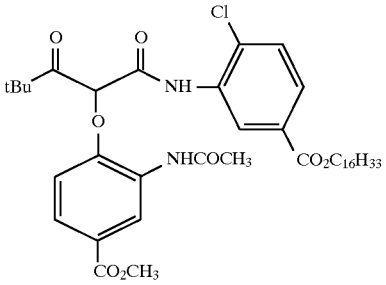
C-5
-continued
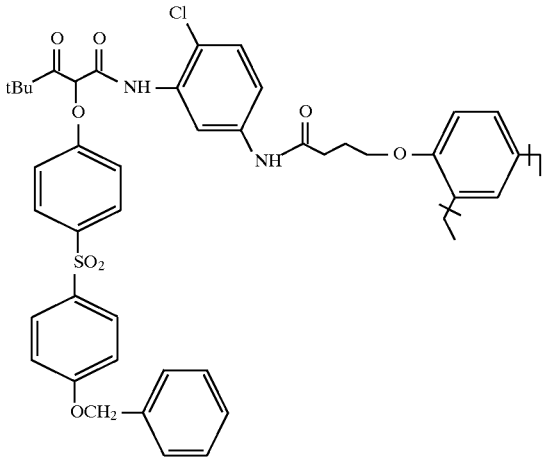
C-6
Table I
| Coupler # | Type | Samples Tested: Within Invention Yes (Y) No (N) | |
|---|---|---|---|
| Y-1 | Invention | Y | Y |
| C-1 | Comparative | Y | N |
| C-2 | Comparative | N | Y |
| C-3 | Comparative | N | Y |
| C-4 | Comparative | N | Y |
| C-5 | Comparative | N | Y |
| C-6 | Comparative | N | N |

TABLE II

| Coupler | Type | Dmax | Dmin | Contrast | Speed | λmax | 50 Klux Daylight (2 weeks) Dye density loss at densities of 0.5 | 1.0 | 1.7 | Print-out |
|---|---|---|---|---|---|---|---|---|---|---|
| Y-1 | Inv | 2.83 | 0.08 | 3.11 | 177 | 447 | −0.27 | −0.22 | −0.24 | 0.01 |
| C-1 | Comp | 1.32 | 0.06 | 1.35 | 155 | 442 | −0.36 | −0.56 | / | 0.02 |

TABLE III

| Coupler | Type | Dmax | Dmin | Contrast | λmax | 50 klux daylight Dye density loss at densities of 0.5 | 1.0 | 1.7 | Dark Keeping 75° C./50% RH 2 weeks, Loss at density = 1 |
|---|---|---|---|---|---|---|---|---|---|
| Y-1 | Inv | 3.06 | 0.092 | 2.77 | 447.1 | −0.09 | −0.10 | −0.14 | None |
| C-2 | Comp | 2.87 | 0.086 | 2.66 | 447.1 | −0.14 | −0.17 | −0.18 | −0.03 |
| C-3 | Comp | 2.52 | 0.086 | 2.63 | 447.4 | −0.06 | −0.07 | −0.09 | −0.02 |
| C-4 | Comp | 2.76 | 0.091 | 2.68 | 446.0 | −0.09 | −0.11 | −0.14 | −0.07 |

TABLE IV

| Coupler | type | Dmax | Dmin | Contrast | λmax | 50 klux daylight Dye density loss at densities of 0.5 | 1.0 | 1.7 | Dark Keeping 75° C./50% RH 2 weeks, Loss at density = 1 |
|---|---|---|---|---|---|---|---|---|---|
| Y-1 | Inv | 2.77 | 0.074 | 2.99 | 446.2 | −0.26 | −0.19 | −0.21 | −0.05 |
| C-5 | Comp | 2.38 | 0.074 | 2.88 | 442.2 | −0.29 | −0.25 | −0.27 | −0.28 |
| C-6 | Comp | 2.19 | 0.067 | 2.45 | 444.6 | −0.20 | −0.18 | −0.35 | −0.04 |

The results in Tables II, III, and IV show the advantages of the invention. Table II shows that the element employing coupler Y-1 of the invention is superior to one using comparison coupler C-1 from U.S. Pat. No. 4,404,274 in each of the parameters listed, even though both the inventive and the comparison coupler comprise the same nitrogen coupling-off group. The parameters include ability to form dye, sensitivity, hue, coupler stability, and dye stability.

Table III shows that inventive coupler Y-1 is superior in every category to C-2, a commercially used yellow coupler. Coupler C-2 contains the same acylacetanilide parent group but employs an oxazolidinedione coupling-off group. Couplers C-3 and C-4 have similar structures to Y-1 (same parent acylacetanilide group), but with coupling-off groups which are different from the invention. Again the elements formed with inventive coupler Y-l provide superior results, particularly with respect to activity and dark keeping.

The element incorporating coupler C-6, which is also a commercially used yellow coupler but one that employs a phenoxy coupling-off group shows similar deficiencies in Table IV. C-5 is similarly deficient in spite of having the same acyacetanilide parent group as Y-1.

What is claimed is:

1. A photographic element comprising a silver halide emulsion layer having associated therewith a yellow dye-forming coupler having the formula:

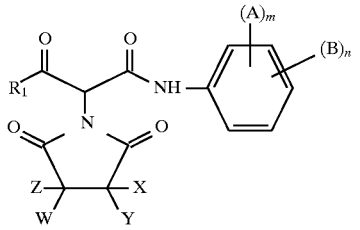

wherein X, Y, Z, W are independently selected from the group consisting of H, alkyl, aryl, halogen, alkoxy and aryloxy groups, provided that X and W may join to form a saturated ring;

Each A is selected from the group consisting of halogen, alkoxy and aryloxy groups;

m is an integer from 1 to 3;

each B is independently selected from the group consisting of —C(O)OR$_2$ and —NHSO$_2$R$_3$ wherein R$_2$ and R$_3$ are independently selected from the group consisting of alkyl and aryl groups;

n is an integer from 1 to 3; and

R$_1$ is a substituent group.

2. The element of claim 1 wherein at least one B is of the formula —C(O)OR$_2$ wherein R$_2$ is an alkyl or aryl group.

3. The element of claim 2 wherein R$_2$ is an alkyl group.

4. The element of claim 2 wherein R$_2$ contains from 6 to 24 carbon atoms.

5. The element of claim 1 wherein $R_3$ contains from 6 to 24 carbon atoms.

6. The element of claim 1 wherein n is 1.

7. The element of claim 1 wherein A is ortho to the anilino nitrogen.

8. The element of claim 1 wherein X, Y, Z and W are independently selected from the group consisting of H, alkyl and aryl.

9. The element of claim 1 wherein $R_1$ is bonded to the rest of the coupler by a tertiary carbon atom.

10. The element of claim 9 wherein $R_1$ is selected from the group consisting of 1-alkyl substituted cycloalkyl groups having 3 to 7 carbon atoms in the cyclic ring.

11. The element of claim 10 wherein the 1-alkyl group contains from 1 to 6 carbon atoms.

12. The element of claim 11 wherein $R_1$ is selected from the group consisting of 1-methylcyclopropyl, 1-methylcyclobutyl, 1-methylcyclopentyl, and 1-methylcyclohexyl groups.

13. The element of claim 9 wherein $R_1$ is selected from the group consisting of t-butyl, t-octyl, t-pentyl, and adamantyl.

14. The element of claim 1 wherein A is an alkoxy group of up to 24 carbon atoms.

15. The element of claim 1 wherein A is a halogen.

16. The element of claim 1 wherein X, Y, Z, and W are selected from the group consisting of H, methyl, ethyl, methoxy, ethoxy and phenyl.

17. The element of claim 1 wherein the silver halide emulsion layers are disposed on a reflective support.

18. A process for forming an image in an element as described in claim 1 after the element has been imagewise exposed to light comprising contacting the element with a color developing agent.

* * * * *